US012685914B2

(12) United States Patent
Alioto et al.

(10) Patent No.: US 12,685,914 B2
(45) Date of Patent: Jul. 21, 2026

(54) AIMING KEY, PUTTER AND METHOD FOR ENHANCING THE ACCURACY OF AIMING

(71) Applicant: Putter Key, LLC, Corte Madera, CA (US)

(72) Inventors: Lawrence Alioto, Corte Madera, CA (US); David Englefield, Cranleigh (GB)

(73) Assignee: Putter Key, LLC, Corte Madera, CA (US)

( * ) Notice: Subject to any disclaimer, the term of this patent is extended or adjusted under 35 U.S.C. 154(b) by 0 days.

(21) Appl. No.: 19/348,894

(22) Filed: Oct. 3, 2025

(65) Prior Publication Data

US 2026/0027440 A1 Jan. 29, 2026

Related U.S. Application Data

(63) Continuation-in-part of application No. 18/418,266, filed on Jan. 20, 2024, which is a continuation-in-part (Continued)

(51) Int. Cl.
*A63B 69/36* (2006.01)

(52) U.S. Cl.
CPC ..... *A63B 69/3685* (2013.01)

(58) Field of Classification Search
CPC ..... A63B 53/0441; A63B 53/0487
See application file for complete search history.

(56) References Cited

U.S. PATENT DOCUMENTS 3,698,093 A 10/1972 Marshall
4,002,343 A 1/1977 Eckert
(Continued)

FOREIGN PATENT DOCUMENTS

KR 20-0341646 2/2004
KR 20-0432095 11/2006
(Continued)

OTHER PUBLICATIONS

Konglong kanglang, Golf Putting Alignment Aiming Tool, published on Aug. 7, 2024(online). Retrieved from Internet on Sep. 13, 2024. https://www.ebay.com/itm/226281693722 (Year: 2024).
(Continued)

*Primary Examiner* — Michael D Dennis
(74) *Attorney, Agent, or Firm* — The Law Office of Kevin McDermott, P.L.L.C.

(57) ABSTRACT

An aiming key for enhancing the accuracy of aiming while putting a golf ball is provided that includes a body having a pair of parallel sides. Each side has a first terminus and a second terminus and a first end extends between the first terminus of each side. Moreover, the body includes an arcuate second end extending between the second terminus of each side, a circular target proximate the second arcuate end, an interior opening including a first interior end and a second interior end. Furthermore, the body includes an aiming member aimed at a center of the target. The aiming member includes a first aiming member side, a second aiming member side, an aiming member end and an elongated cut-out intermediate the first and second aiming member sides. The cut-out and the aiming member sides are parallel to the parallel sides and the cut-out extends through the body.

15 Claims, 9 Drawing Sheets

Related U.S. Application Data of application No. 18/516,791, filed on Nov. 21, 2023, now Pat. No. 11,980,794.

(56) References Cited

U.S. PATENT DOCUMENTS

| | | | | |
|---|---|---|---|---|
| 4,025,078 | A | 5/1977 | Pelz | |
| D248,050 | S | 5/1978 | Mueh | |
| 4,601,472 | A | 7/1986 | O'Flanagan | |
| D308,238 | S | 5/1990 | Francu | |
| D316,129 | S | 4/1991 | Bryson | |
| 5,350,177 | A | 9/1994 | Furbush, Jr. | |
| D353,178 | S | 12/1994 | Koleoglou | |
| 5,409,228 | A | 4/1995 | Botsch | |
| D360,446 | S | 7/1995 | Juliano | |
| 5,478,078 | A | 12/1995 | Lee | |
| D380,801 | S | 7/1997 | Steele | |
| 5,830,078 | A | 11/1998 | McMahan | |
| 5,921,868 | A * | 7/1999 | DiMartino | A63B 69/3685 473/340 |
| 5,924,935 | A | 7/1999 | Prewitt | |
| 6,159,108 | A | 12/2000 | de la Pena | |
| 6,176,792 | B1 | 1/2001 | Tate | |
| 6,464,596 | B1 | 10/2002 | Belding | |
| 6,702,688 | B2 | 3/2004 | Hale | |
| 6,821,212 | B2 | 11/2004 | Fowler et al. | |
| D502,519 | S | 3/2005 | Kang | |
| D506,796 | S | 6/2005 | Li | |
| D507,316 | S | 7/2005 | Li | |
| 6,988,955 | B2 | 1/2006 | Stoakes | |
| 7,001,284 | B2 | 2/2006 | Edel | |
| D518,127 | S | 3/2006 | Tang et al. | |
| D520,583 | S | 5/2006 | Rollinson et al. | |
| D523,102 | S | 6/2006 | Stites et al. | |
| D523,915 | S | 6/2006 | Bergstrom | |
| D529,108 | S | 9/2006 | Stites et al. | |
| D531,242 | S | 10/2006 | Adams | |
| D532,067 | S | 11/2006 | Soracco et al. | |
| D533,609 | S | 12/2006 | Moore et al. | |
| D539,860 | S | 4/2007 | Fussell | |
| D542,869 | S | 5/2007 | Adams | |
| D550,795 | S | 9/2007 | Tateno | |
| D559,930 | S | 1/2008 | Cameron | |
| 7,341,526 | B2 | 3/2008 | McCarthy | |
| D569,461 | S | 5/2008 | Morris | |
| 7,371,184 | B2 | 5/2008 | Tao | |
| D572,780 | S | 7/2008 | Rollinson | |
| D575,366 | S | 8/2008 | Rollinson | |
| D582,498 | S | 12/2008 | Austin | |
| D603,008 | S | 10/2009 | Donahue | |
| 7,674,186 | B2 | 3/2010 | Bitco et al. | |
| D619,665 | S | 7/2010 | Rollinson et al. | |
| 7,758,439 | B2 * | 7/2010 | Roenick | A63B 60/00 473/238 |
| 7,758,451 | B2 | 7/2010 | Liang et al. | |
| D620,993 | S | 8/2010 | Laub | |
| D621,462 | S | 8/2010 | Serrano et al. | |
| D629,476 | S | 12/2010 | Serrano et al. | |
| D632,748 | S | 2/2011 | Serrano et al. | |
| D643,486 | S | 8/2011 | Serrano et al. | |
| 8,075,416 | B2 | 12/2011 | Stites et al. | |
| D681,145 | S | 4/2013 | Pfaff et al. | |
| D681,760 | S | 5/2013 | Pfaff et al. | |
| D689,968 | S | 9/2013 | Jones | |
| 8,550,932 | B2 | 10/2013 | Franklin et al. | |
| D704,287 | S | 5/2014 | Tang et al. | |
| D710,470 | S | 8/2014 | Trahan et al. | |
| D713,907 | S | 9/2014 | Hilton | |
| D713,909 | S | 9/2014 | Hilton | |
| D741,428 | S | 10/2015 | Wong | |
| D769,993 | S | 10/2016 | Abbott et al. | |
| D773,572 | S | 12/2016 | Rollinson | |
| D777,269 | S | 1/2017 | Becktor et al. | |
| D796,605 | S | 9/2017 | Serrano et al. | |
| D801,458 | S | 10/2017 | Rollinson et al. | |
| D813,963 | S | 3/2018 | Lapuz | |
| 10,293,237 | B1 | 5/2019 | Hilton et al. | |
| D852,300 | S | 6/2019 | Wang et al. | |
| D852,498 | S | 7/2019 | Sassi | |
| D860,350 | S | 9/2019 | Rollinson | |
| 10,994,178 | B1 | 5/2021 | Janus, Sr. et al. | |
| D931,395 | S | 9/2021 | Michelini | |
| D982,686 | S | 4/2023 | Toulon et al. | |
| 11,980,794 | B1 * | 5/2024 | Englefield | A63B 53/0487 |
| D1,040,957 | S | 9/2024 | Serrano | |
| 12,311,246 | B1 | 5/2025 | Arnold | |
| 2002/0061785 | A1 | 5/2002 | Elias | |
| 2002/0103039 | A1 | 8/2002 | Shmoldas et al. | |
| 2002/0107086 | A1 | 8/2002 | Cameron | |
| 2004/0063516 | A1 | 4/2004 | Cameron | |
| 2005/0020380 | A1 | 1/2005 | Yamaguchi et al. | |
| 2005/0159241 | A1 | 7/2005 | Hou | |
| 2005/0192114 | A1 | 9/2005 | Zider et al. | |
| 2005/0202895 | A1 | 9/2005 | Hueber | |
| 2006/0030419 | A1 | 2/2006 | Koster | |
| 2006/0094521 | A1 | 5/2006 | Burns | |
| 2006/0094522 | A1 | 5/2006 | Tang et al. | |
| 2007/0021229 | A1 | 1/2007 | Haack | |
| 2007/0225085 | A1 | 9/2007 | Koide et al. | |
| 2007/0238547 | A1 | 10/2007 | Jones | |
| 2009/0082123 | A1 | 3/2009 | Armstrong | |
| 2009/0215547 | A1 | 8/2009 | Hegarty | |
| 2009/0215551 | A1 | 8/2009 | Liang et al. | |
| 2009/0286612 | A1 | 11/2009 | Pouliot et al. | |
| 2010/0083518 | A1 | 4/2010 | Kramski | |
| 2010/0323807 | A1 | 12/2010 | Rha | |
| 2011/0224014 | A1 * | 9/2011 | Tryner | A63B 53/0487 473/340 |
| 2012/0220386 | A1 | 8/2012 | Snyder et al. | |
| 2013/0012331 | A1 | 1/2013 | Goldsmith et al. | |
| 2013/0178300 | A1 | 7/2013 | Dunn | |
| 2013/0324277 | A1 | 12/2013 | Tien | |
| 2014/0155187 | A1 | 6/2014 | Spelman et al. | |
| 2015/0119160 | A1 | 4/2015 | Franklin | |
| 2022/0305348 | A1 | 9/2022 | Steinhauser | |

FOREIGN PATENT DOCUMENTS

| | | |
|---|---|---|
| KR | 20-0442499 | 11/2008 |
| KR | 10-1159130 | 6/2012 |

OTHER PUBLICATIONS

Cafret, Golf Putting Alignment Aiming Tool, published on Aug. 1, 2024(online). Retrieved from Internet on Sep. 13, 2024. https://www.ebay.com/itm/355917873487 (Year: 2024).

SobojinskiSolutions, Precision Point Ball Marker, published on Oct. 27, 2023[online]. Retrieved Sep. 13, 2024. https://www.etsy.com/listing/1534296467/precision-point-ball-marker?

Hagenes, Clock Face Clip Art No Hands, published on Jul. 29, 2023[online]. Retrieved Sep. 13, 2024. https://learningmediapulsation.z22.web.core.windows.net/clock-face-clip--art-no-hands.

PGM, Golf Standing Putter with Alignment Aid, 04/2202023, retrieved from the Internet https://www.amazon.com/PGM-Golf-Putter-Forgiveness-Alignment.

Huaen, Golf Putter with Alignment Aid, May 4, 2024 online.https://www.amazon.com/HUAEN-Golf-Putter-Alignment-Aid/dp/B0D38NR68N/.

International Search Report and Written Opinion of ISA dated Dec. 4, 2024 for International Application No. PCT/IB2024/000406, pp. 1-19.

Mygolfspy,Amazon Finds:Golf Ball Marking Level, published on Sep. 8, 2023[online].Retrieved from Internet (Date:Sep. 13, 2024),https://mygolfspy.com/we-tried-it/amazon-finds-golf-ball/.

* cited by examiner

AIMING KEY, PUTTER AND METHOD FOR ENHANCING THE ACCURACY OF AIMING

CROSS REFERENCE TO RELATED APPLICATIONS

This is a continuation-in-part application of U.S. patent application Ser. No. 18/418,266, filed Jan. 20, 2024, which is a continuation-in-part application of U.S. patent application Ser. No. 18/516,791, filed Nov. 21, 2023, now U.S. Pat. No. 11,980,794, issued May 14, 2024, the entire disclosures of which are incorporated herein by reference.

BACKGROUND OF THE INVENTION

This invention relates generally to aiming, and more particularly, to an aiming key, a putter, and a method for enhancing the accuracy of aiming.

Putting may be one of the more difficult and important aspects of golf to master and constitutes a substantial portion of golf scores. Golfers should invest substantial time in putting practice to become better putters, but most golfers do not have the time. It is generally known that most golfers desire to improve their putting.

Putting involves gently swinging the head of a putter across a golfer's body, from one side to another, to gently hit a golf ball in the direction of a hole located in the green. Typically, a golfer aims at the hole using the line etched into his or her putter. After mentally establishing a desired line or path between the face of the putter, the ball and the hole, the golfer gently executes his or her putting stroke to strike the ball. However, golfers generally do not face the hole and generally do not concentrate on gently hitting the golf ball into the hole while putting. Instead, golfers face the golf ball and concentrate on making contact with the golf ball while putting. As a result, more often than not the golf ball does not follow the desired path so does not go into the hole. The ball may not follow the desired path because the golfer may move the putter off the desired path while executing his or her putting stroke.

In many competitive games a player is required to aim at an object to establish a desired line of sight. For example, rifle marksmen use a line etched in a scope which is inches from his or her face to aim at an object to establish a desired line of sight. As discussed above, golfers are known to use lines etched in their putters to aim at a hole located in a green to establish a desired line of sight between the putter and the hole. However, this technique typically does not reliably produce the desired result in golf.

Thus, it would be advantageous and an improvement over the relevant technology to provide an aiming key, a putter and a method for enhancing the accuracy of aiming that allows golfers to reliably putt a golf ball into the hole located in the green.

BRIEF DESCRIPTION OF THE INVENTION

In one aspect, an aiming key for enhancing the accuracy of aiming while putting a golf ball is provided. The aiming key includes a body having a pair of parallel sides, a first end including an aiming member, a second end including a target, a top surface, and a bottom surface. The top and bottom surfaces are separated by a distance. Moreover, the body includes an interior opening that extends part of the distance from the top surface to the bottom surface. The aiming member extends into the opening and is aimed at a center of the target.

In one embodiment, the target is circular and in another embodiment the target protrudes into the open space.

In another embodiment, the target is circular and has a perimeter, and includes indicia about the perimeter.

In yet another embodiment, the target is circular and is rotatable about the center.

In another embodiment, the interior opening includes a pair of interior parallel sides. Each interior parallel side is offset from a respective parallel side of the body.

In yet another embodiment, the body is made from plastic, aluminum, metal, wood, graphite, carbon fiber, or a composite including any of these materials.

In another aspect, a putter for enhancing the accuracy of aiming while putting a golf ball is provided. The putter includes a longitudinal shaft having a first end and a second end, and a putter head attached to the second end. The putter head has a front portion and a back portion. The back portion includes a body including a pair of parallel sides, a first end including an aiming member, a second end including a target, a top surface, and a bottom surface. The top and bottom surfaces are separated by a distance. Moreover, the body includes an interior opening that extends part of the distance from the top surface to the bottom surface. The aiming member extends into the opening that and is aimed at a center of the target.

In an embodiment, the target is circular, square, diamond-shaped, oval or star-shaped.

In another embodiment, the body is made from plastic, aluminum, metal, wood, graphite, carbon fiber, or a composite including any of these materials.

In yet another embodiment, the target is circular, has a perimeter and includes indicia about the perimeter.

In another embodiment, the target is circular, has a center and is rotatable about the center.

In yet another aspect, a method for enhancing the accuracy of aiming while putting a golf ball with a putter is provided. A head of the putter includes a body having a first end, a second end, a top surface and a bottom surface. The top and bottom surfaces are separated by a distance. Moreover, the body includes an interior opening extending part of the distance from the top surface to the bottom surface. The aiming member extends into the opening and towards a center of the target. The method includes the steps of focusing on a pointed end of the aiming member and aligning the pointed end with a hole in the ground, executing a backswing while concentrating on moving the pointed end of the aiming member towards the center of the target, executing a forward swing towards the golf ball, and striking the golf ball to translate the golf ball along the alinement towards the hole.

In one embodiment, the target is circular and rotatable about the center and the method further includes rotating the target to a desired position.

In another aspect, an aiming key for enhancing the accuracy of aiming while putting a golf ball is provided that includes a body. The body includes a pair of parallel sides, each side having a first terminus and a second terminus. Moreover, the body includes a first end extending between the first terminus of each side. The first end is removably attachable to a putter. Furthermore, the body includes an arcuate second end extending between the second terminus of each side, a circular target proximate the second arcuate end, and an interior opening including a first interior end and a second interior end. The interior opening extends through the body and is between the parallel sides. Additionally, the body includes an aiming member aimed at a center of the target. The aiming member includes a first aiming member side, a second aiming member side, an aiming member end and an elongated cut-out intermediate the first and second aiming member sides. The cut-out and the aiming member sides are parallel to the parallel sides and the cut-out extends through the body.

In yet another aspect of the present disclosure an aiming key for enhancing the accuracy of aiming while putting a golf ball is provided that includes a body. The body includes a first end and an arcuate second end. The first end is removably attachable to a putter. Further, the body includes, a circular target proximate the arcuate second end, and a first side and a second side. The first and second sides are parallel. The first side has a first side end and a second side end. The second side has a first side end and a second side end. The first end extends from the first side first end to the second side first end and the arcuate second end extends from the first side second end to the second side second end.

Moreover, the body includes an interior opening including a first interior end and a second interior end. The interior opening extends through the body and is between the first and second sides. The body also includes an aiming member aimed at a center of the target. The aiming member includes a first aiming member side, a second aiming member side, an aiming member end and an elongated cut-out intermediate the first and second aiming member sides. The cut-out and the aiming member sides are parallel to the first and second sides, the cut-out extends through the body, and the aiming member end is separated from the target by a distance.

In yet another aspect of the present disclosure a method for attaching an aiming key to a putter head is provided that includes manipulating an aiming key to be proximate a putter head. The aiming key includes an elongated cut-out and an end, and the putter head includes an aiming line and a front face. Moreover, the method includes aligning the cut-out with the aiming line and the end of the aiming key with the front face, and positioning a bottom of the aiming key against a top of the putter head. The bottom includes an adhesive strip. Further, the method includes attaching the aiming key to the putter head by pressing the aiming key and thus the adhesive strip against the top of the putter head.

DETAILED DESCRIPTION OF THE INVENTION

The following detailed description is made with reference to the accompanying drawings and is provided to assist in a comprehensive understanding of various example embodiments of the present disclosure. The following description includes various details to assist in that understanding, but these are to be regarded merely as examples and not for the purpose of limiting the present disclosure as defined by the appended claims and their equivalents. The words and phrases used in the following description are merely used to enable a clear and consistent understanding of the present disclosure. In addition, descriptions of well-known structures, functions, and configurations may have been omitted for clarity and conciseness. Those of ordinary skill in the art will recognize that various changes and modifications of the example embodiments described herein can be made without departing from the spirit and scope of the present disclosure.

Figure 1:
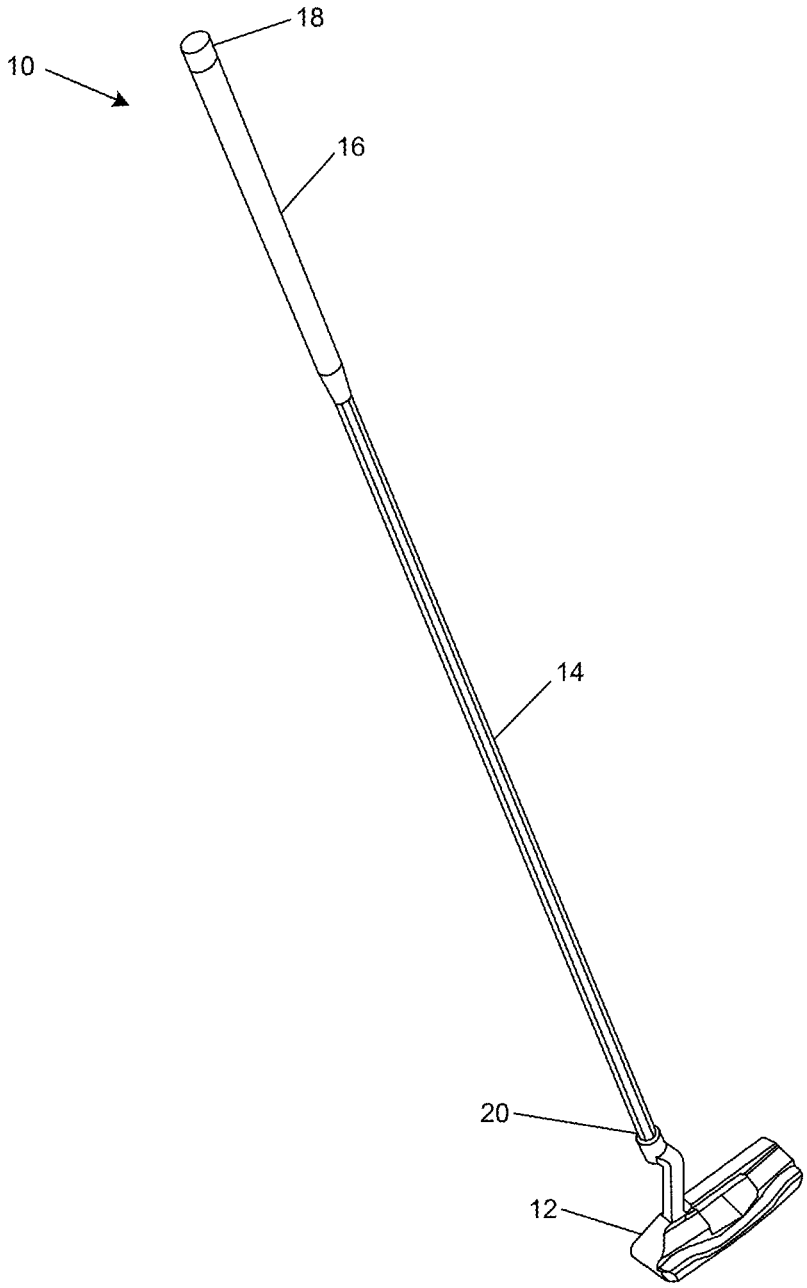
FIG. 1 is a perspective view of an example golf putter.

FIG. 1 is a perspective view of an example golf putter 10. More specifically, the putter 10 includes an example putter head 12, a shaft 14 and a gripping region 16. The putter shaft 14 includes a first end 18 and a second end 20. The putter head 12 may be fixedly attached to either the first 18 or second 20 ends while the gripping region 16 may be attached to the opposite end. The gripping region 16 is for ensuring that golfers are able to securely grasp the putter shaft 14 while putting.

Figure 2:
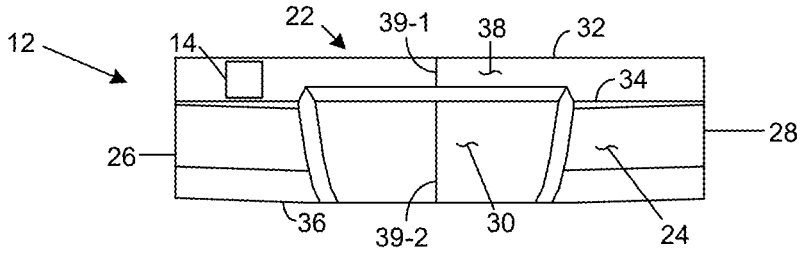
FIG. 2 is an enlarged top view of an example golf putter head included in the golf putter as shown in FIG. 1.

FIG. 2 is an enlarged top view of the example putter head 12 as shown in FIG. 1. More specifically, the head 12 includes a front portion 22, a back portion 24, a heel 26, a toe 28, and a recess 30. The front portion 22 includes a front face 32 and a back face 34. The back portion 24 extends away from the back face 34 to define a rear edge 36 of the back portion 24. The recess 30 extends from the back face 34 to the rear edge 36. The front portion 22 also includes a top surface 38. The example putter head 12 is a blade type putter head. The putter head 12 includes an aiming line 39-1, for example, etched in the top surface 38 and another aiming line 39-2, for example, etched in the recess 30. Aiming lines typically correspond to the so-called sweet spot of the putter.

Figure 3:
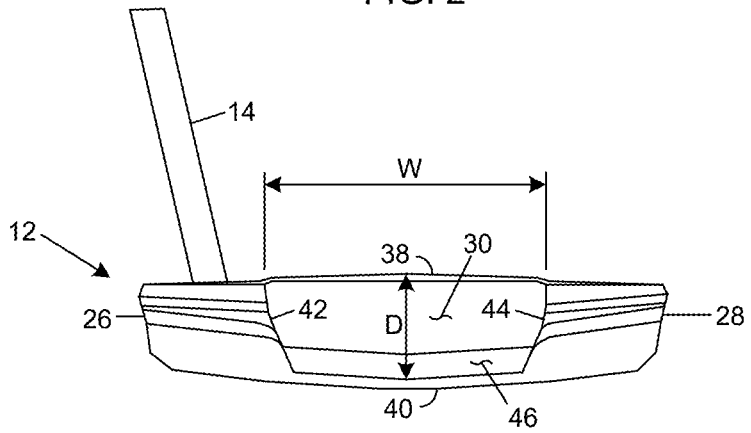
FIG. 3 is an enlarged back view of the example golf putter head as shown in FIGS. 1 and 2.

The example putter head 12 illustrated in FIG. 3 is similar to the putter head illustrated in FIG. 2. As such, features illustrated in FIG. 3 that are identical to features illustrated in FIG. 2 are identified using the same reference numerals used in FIG. 2.

FIG. 3 is an enlarged back view of the example golf putter head 12 as shown in FIGS. 1 and 2, further including a bottom surface 40. The height of the putter 12 can be the distance between any point on the top surface 38 and a corresponding point on the bottom surface 40. The recess 30 may have a width W equal to about half the distance from the heel 26 to the toe 28, and may have a depth D approximately equal to the height of the head 12. The recess 30 may have a cross section that resembles a channel, for example, a C-shaped or U-shaped channel. As a result, the recess 30 includes a first side 42, a second side 44, and a bottom 46. The bottom 46 can be flat or can slope from the back face 34 towards the rear edge 36. The depth D can be the distance between the bottom 46 of the recess 30 and the top portion 38 of the putter 12.

Figure 4:
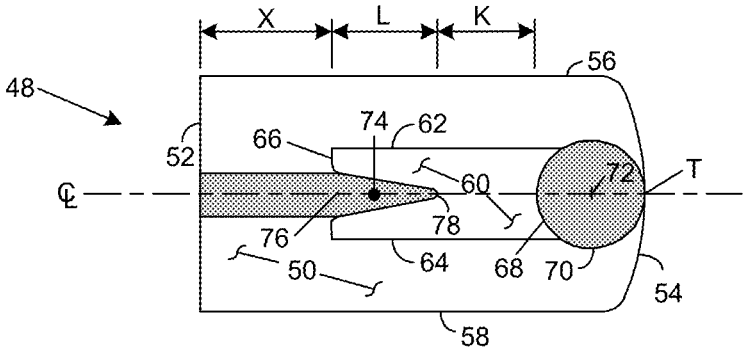
FIG. 4 is a diagram illustrating an example aiming key according to an embodiment of the present disclosure.

FIG. 4 is a diagram illustrating an example aiming key 48 according to an embodiment of the present disclosure. More specifically, the aiming key 48 includes a body 50 having a first end 52, a second end 54, a first side 56 and a second side 58. The first 56 and second 58 sides are parallel to each other while the first end 52 extends between a first end of the first 56 and second sides 58. The first end of the first side 56 and the first end of the second side 58 may each alternatively be referred to as a first terminus. The first end 52 may be normal to both the first 56 and second 58 sides. The second end 54 can be arcuate and extends between a second end of the first 56 and second 58 sides. The second end of the first side 56 and the second end of the second side 58 may alternatively be referred to as a second terminus. Thus, the aiming key 48 generally resembles a rectangle. However, it is contemplated by the present disclosure that the aiming key 48 may have or resemble any other geometric shape, for example, a square, that facilitates enhancing the accuracy of a golfer's aim during putting as described herein. Although the second end 54 is described herein as being arcuate, the second end 54 may alternatively have any shape including, but not limited to, a straight line. The first end 52, the second end 54, the first side 56, and the second side 58 may alternatively be referred to as edges.

An opening 60 may be located in an interior of the body 50 and may extend along a length of the body 50. The opening 60 may have a first interior side 62, a second interior side 64, a first interior end 66, and a second interior end 68. The length of the first 62 and second 64 interior sides can be thirty-four (34) millimeters while the perpendicular distance between the first 62 and second 64 interior sides may be thirteen (13) millimeters. It is contemplated by the present disclosure that the first 62 and second 64 interior sides may alternatively be of any length, and the perpendicular distance between the sides 62 and 64 may be any distance that facilitates enhancing the accuracy of a golfer's aim aiming while putting as described herein. The distance between the first sides 56 and 62 may be the same as the distance between the second sides 58 and 64. Thus, the opening 60 may be centered between the first 56 and second 58 sides. The opening 60 may extend through the body 50.

The first 62 and second 64 interior sides may be parallel to the first 56 and second 58 sides, respectively. Alternatively, the first 62 and second 64 sides may not be parallel to the sides 56 and 58, respectively. For example, the first 62 and second 64 sides may taper towards each other. The first 62 and second 64 interior sides are shorter than the sides 56 and 58. The opening 60 is generally rectangular. However, the opening 60 may alternatively be, or generally resemble any other shape, for example, a square or oval.

The body 50 may also include a circular target 70 that may be positioned at or proximate the second end 54 of the body 50. The target 70 may be positioned to extend from the second end 54 into the opening 60. Moreover, the perimeter of the target 70 may be coincident with the second end 54 at a point of tangency T common to the target 70 and the second end 54. Alternatively, the perimeter of the target 70 may not be coincident with the second end 54. Rather, the perimeter of the target 70 may be offset from the end 54 by any distance, for example, one (1) millimeter.

It is contemplated by the present disclosure that the perimeter of the target 70 may define the shape of the second interior end 68. Thus, the shape of the second interior end 68 may be an arc defined by the perimeter of the circular target 70. The target 70 has a center 72 and may be an integral part of the body 50 or may be fixedly attached thereto. The overall length of the aiming key 48 as measured from the first end 52 to the point T can be sixty-six (66) millimeters, and the overall width measured as the length of the first end 52 may be thirty-five (35) millimeters. Alternatively, the overall length and overall width may be any distance that facilitates enhancing the accuracy of aiming as described herein.

The aiming key 48 also includes an aiming member 74. The aiming member 74 has a base 76 and two sides. The base 76 is positioned in the middle of the first interior end 66. The aiming member 74 extends a distance L into the opening 60. The distance L is measured perpendicular to the first interior end 66. The aiming member sides taper over the distance L to an end 78. The end 78 may be rounded or pointed. Thus, the aiming member 74 may have a triangular shape. However, it is contemplated by the present disclosure that the aiming member 74 may alternatively have any shape, for example, rectangular that enhances putting as described herein.

The end 78 is separated from the perimeter of the target 70 by a distance K. The distance K may be, for example, half an inch. Alternatively, the distance K may be any distance that facilitates enhancing a golfer's aim as described herein. Moreover, the distances K and L are variable so may be adjusted in any manner that facilitates enhancing the accuracy of a golfer's aim as described herein.

The aiming member 74 is oriented to point directly at the center 72 of the target 70. The distance L may be one and six tenths (1.6) centimeters or any length that facilitates enhancing the accuracy of aiming as described herein. A distance X between the first end 52 and the first interior end 66 can be one and nine tenths (1.9) centimeters. Alternatively, the distance X can be any distance that facilitates enhancing the accuracy of aiming as described herein. The base 76 may be one-quarter of an inch (¼"). However, the base 76 may alternatively have any width that facilitates enhancing the accuracy of aiming as described herein.

The target 70 and the aiming member 74 are shaded. The shading for the aiming member 74 extends from the end 78 to the base 76. The shading also extends from the base 76 to the first end 52 of the aiming key 48. The shading extending from the base 76 to the first end 52 can be the same width as the base 76. Alternatively, the shading from the base 76 to the end 52 may be any width or may extend in any manner between the base 76 and the end 52.

The shading represents a surface treatment, for example, paint or a sticker applied to the aiming key 48. The surface treatment may be any color or design. Stickers may be attached to the aiming key 48 using adhesive. Paint may be applied to the aiming key 48 in any manner, for example, using a brush or screen printing. The shading between the first interior end 66 and the first end 52 functions to visually lengthen the aiming member 74 such that golfers perceive the aiming member 74 as extending from the first end 52 to the end 78. This visual effect helps golfers to aim at a hole in the green and to concentrate on the relationship between the aiming member 74 and the target 70 while putting, to thus facilitate hitting a golf ball along a desired alinement or path into the hole. Thus, it is contemplated by the present disclosure that the aiming member 74 may alternatively include the shading between the first interior end 66 and the first end 52.

For such an aiming member 74, the shading between the first interior end 66 and the first end 52 may be considered a first length while the part that extends a distance L into the opening 60 may be considered a second length. The second length may also be referred to as a triangular part.

A centerline of the aiming key 48 extends intermediate the first and second aiming member sides, through the end 78, and through the center 72 of the target 70.

The aiming key 48 may be made of plastic, aluminum, steel, wood, any other type of metal, graphite, carbon fiber or a composite of any of these materials.

The information shown in FIGS. 5-17 is the same information as shown in FIG. 4, as described in more detail below. As such, components illustrated in FIGS. 5-11 that are identical to components illustrated in FIG. 4, are identified using the same reference numerals used in FIG. 4.

Figure 5:
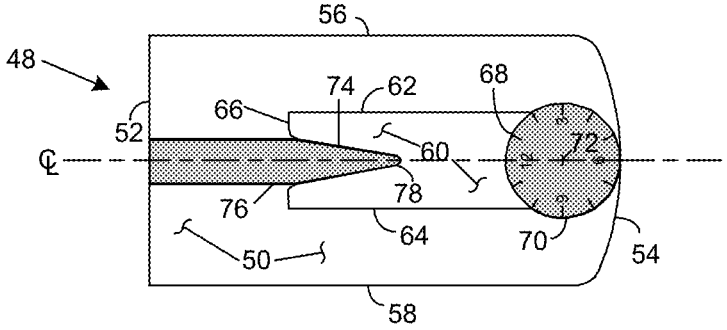
FIG. 5 is a diagram illustrating the example aiming key as shown in FIG. 4, wherein an example target in the aiming key is rotatable.

FIG. 5 is a diagram illustrating the example aiming key 48 as shown in FIG. 4. However, the target 70 is rotatable. For example, the target 70 may be a rotatable dial. The rotatable target 70 may be mounted to the body 50 using any arrangement that allows the target 70 to rotate about the center 72 and at the same time be securely fixed to the aiming key 48. The rotatable target 70 may have indicia thereon similar to the face of a clock. Twelve o'clock may be oriented such that the aiming member 74 points directly at twelve o'clock as well as at the center 72 of the target 70. Alternatively, the target 70 may have any indicia thereon that facilitates enhancing the accuracy of aiming while putting as described herein. The indicia may be applied to the target 70, for example, as paint or as a sticker.

The target 70 may be rotated in a manner that causes the aiming member 74 to point directly at a different time as well as the center 72 of the target 70. For example, the target 70 may be rotated such that the aiming member 74 points directly at ten o'clock as well as at the center 72 of the target 70.

Figure 6:
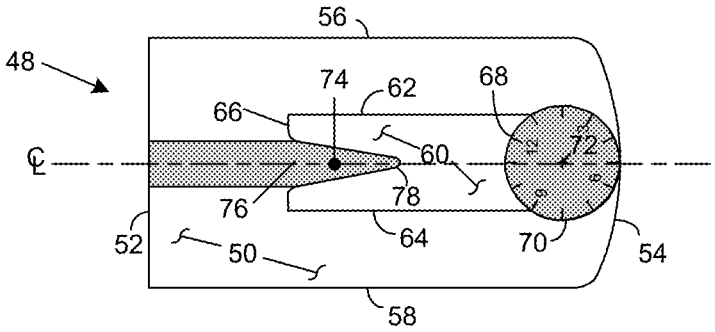
FIG. 6 is a diagram illustrating the example aiming key as shown in FIG. 5; however, the example target has been rotated into a different position.

FIG. 6 is a diagram illustrating the example aiming key 48 as shown in FIG. 5. However, the target 70 has been rotated into a different position. More specifically, the target 70 has been rotated such that the aiming member 74 points directly at eleven o'clock and at the center 72 of the target 70.

Although the target 70 is circular in the examples described herein, it is contemplated by the present disclosure that the target 70 may have any shape that facilitates manipulating the putter head 12 to accurately aim the putter head 12 to strike a golf ball so the golf ball travels along an alinement, or a desired path and into the hole in a green. For example, the target 70 may alternatively be star-shaped, diamond-shaped, square, rectangular, or oval. The alinement, or desired path may be, for example, a straight line, curvilinear, or a combination of straight and curvilinear.

Figure 7:
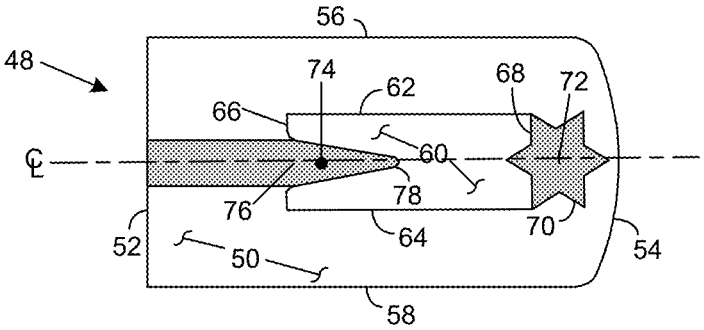
FIG. 7 is a diagram illustrating the example aiming key as shown in FIG. 4; however, the target is star-shaped.

FIG. 7 is a diagram illustrating the example aiming key 48 as shown in FIG. 4. However, the target 70 is star-shaped and is offset from the second end 54.

Figure 8:
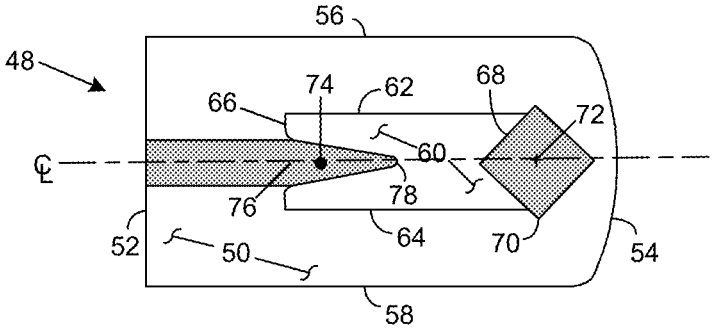
FIG. 8 is a diagram illustrating the example aiming key as shown in FIG. 4; however, the target is diamond-shaped.

FIG. 8 is a diagram illustrating the example aiming key 48 as shown in FIG. 4. However, the target 70 is diamond-shaped and is offset from the second end 54.

Figure 9:
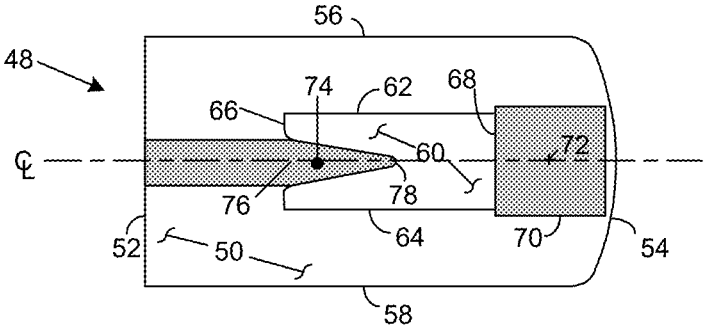
FIG. 9 is a diagram illustrating the example aiming key as shown in FIG. 4; however, the target is square.

FIG. 9 is a diagram illustrating the example aiming key 48 as shown in FIG. 4. However, the target 70 is square and is offset from the second end 54.

Figure 9A:
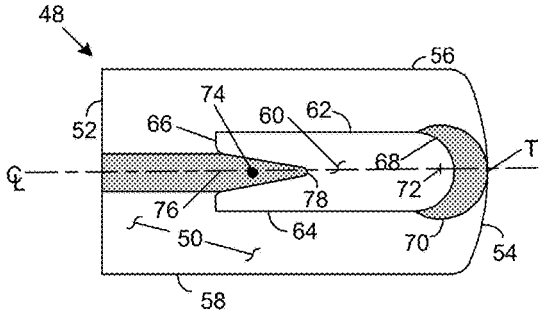
FIG. 9A is a diagram illustrating the example aiming key as shown in FIG. 4; however, the target resembles a crescent moon.

FIG. 9A is a diagram illustrating the example aiming key as shown in FIG. 4. However, the target 70 resembles a crescent moon. More specifically, the target 70 includes a concave portion which causes the interior end 68 to be concave.

Figure 9B:
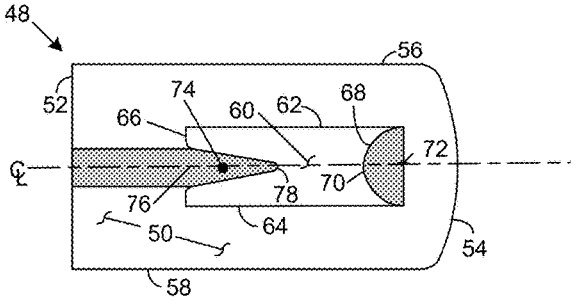
FIG. 9B is a diagram illustrating the example aiming key as shown in FIG. 4; however, the target resembles a half-moon.

FIG. 9B is a diagram illustrating the example aiming key as shown in FIG. 4. However, the target 70 resembles a half-moon.

Figure 10:
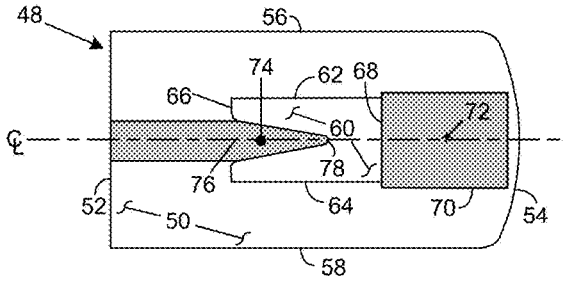
FIG. 10 is a diagram illustrating the example aiming key as shown in FIG. 4; however, the target is rectangular.
Figure 11:
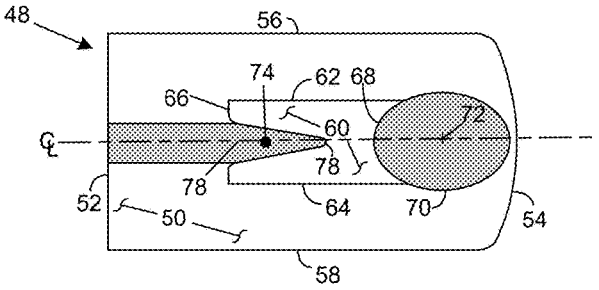
FIG. 11 is a diagram illustrating the example aiming key as shown in FIG. 4; however, the target is oval.

FIG. 10 is a diagram illustrating the example aiming key 48 as shown in FIG. 4. However, the target 70 is rectangular and is offset from the second end 54. FIG. 11 is a diagram illustrating the example aiming key 48 as shown in FIG. 4. However, the target 70 is oval and is offset from the second end 54.

It is contemplated by the present disclosure that each of the example targets 70 as shown in FIGS. 5-11 that does not extend to the second end 54, may alternatively extend to the second end 54 and may be tangent to the second end 54 at, for example, the point of tangency T.

Figure 12:
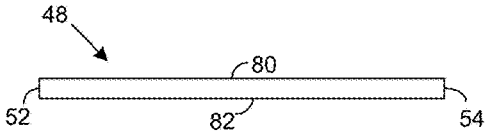
FIG. 12 is a diagram illustrating a side view of the aiming key.

FIG. 12 is a diagram illustrating a side view of the aiming key 48. More specifically, the aiming key 48 includes a top surface 80 and a bottom surface 82. The thickness of the aiming key 48 is measured as the distance between the top 80 and the bottom 82 surfaces. The thickness can be, for example, ten (10) millimeters. Alternatively, the thickness of the aiming key 48 can be any thickness, for example, the distance D between the top 38 and bottom 40 surfaces of the putter head 12, that facilitates enhancing the accuracy of aiming while golfing as described herein. The opening 60 may pass through the aiming key 48 from the top surface 80 to the bottom surface 82. However, it is contemplated by the present disclosure that the opening 60 may alternatively extend from the top surface 80 toward the bottom surface 82 without completely passing through the aiming key 48.

Figure 13:
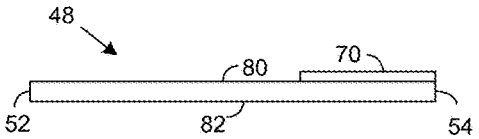
FIG. 13 is a diagram illustrating the side view of the aiming key as shown in FIG. 12, further including a rotatable target mounted on a top surface of the aiming key.

FIG. 13 is a diagram illustrating the side view of the aiming key 48 as shown in FIG. 12, further including the rotatable target 70 mounted on the top surface 80.

Figure 13A:
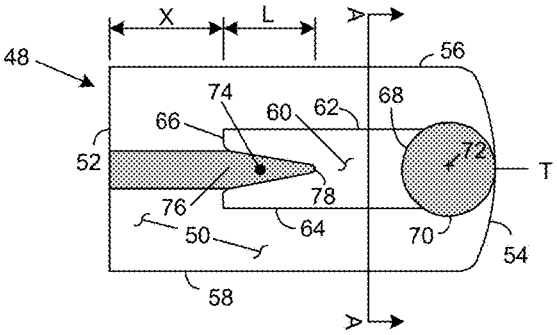
FIG. 13A is a diagram illustrating the example aiming key as shown in FIG. 4; however, an opening extends part of the distance from a top to a bottom surface of the aiming key.

FIG. 13A is a diagram illustrating the example aiming key 48 as shown in FIG. 4. However, instead of extending through the aiming key 48, the opening 60 extends part of the way through the aiming key 48 from the top 80 surface towards the bottom surface 82.

Figure 13B:
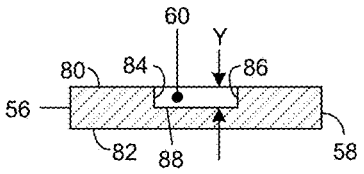
FIG. 13B is a diagram illustrating a cross section of the example aiming key as shown in FIG. 13A.

FIG. 13B is a diagram illustrating a cross section of the aiming key 48 taken along the section line A-A as shown in FIG. 13A. More specifically, the opening 60 extends a distance Y from the top surface 80 towards the bottom surface 82. The distance Y may be any distance that is less than the thickness of the aiming key 48. The distance Y may be zero. When the distance Y is zero, an area having the same outline as the opening 60 may be painted on the top surface 80. When putting, the painted area may be used by a golfer in conjunction with the aiming member 74 and the target 70 in the same manner as when the opening 60 extends partially or completely through the key 48. The paint may be any color. The color may match the color of the paint used to create the target 70 and/or the aiming member 74. The paint may be applied in any manner, for example, using a brush or screen painting. Instead of using paint, a sticker having the same outline as the opening 60 may be attached to the aiming member 48 using adhesive.

The opening 60 may have sides 84 and 86, and a bottom 88. The sides 84, 86 may be normal to the top surface 80. Alternatively, the sides 84 and 86 may be oriented at any angle with respect to the top surface 80. Moreover, the sides 84 and 86 may be curved or a combination of curved and linear. The bottom 88 may be horizontal. Alternatively, the bottom 88 may be oriented at any angle with respect to the sides 84 and 86 and may be curved or a combination of curved and linear.

It is contemplated by the present disclosure that the material of the aiming key 48 between the bottom 88 and the bottom surface 82 may be different than the rest of the aiming key 48. For example, the material between the bottom 88 and the bottom surface 82 may be transparent plastic. The plastic may be any color. Also, it is contemplated by the present disclosure that the part of the aiming key 48 between the bottom 88 and the bottom surface 82 may be manufactured separately and inserted into the opening 60 and attached to the aiming key 48 in any manner, for example, using a snap fit or an adhesive.

Figure 14:
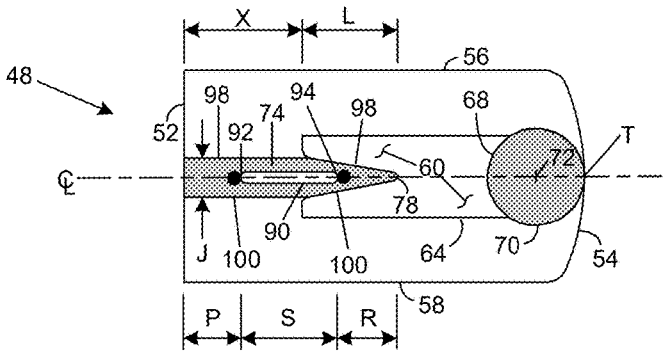
FIG. 14 is a diagram illustrating the example aiming key as shown in FIG. 4, further including a cut-out.
Figure 15:
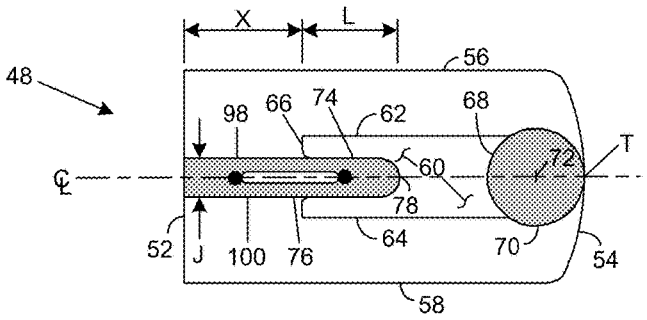
FIG. 15 is a diagram illustrating the example aiming key as shown in FIG. 14; however, the aiming member does not include a triangular part.

The information shown in FIGS. 14 and 15 is the same information as shown in FIG. 4, as described in more detail below. As such, components illustrated in FIGS. 14 and 15 that are identical to components illustrated in FIG. 4, are identified using the same reference numerals used in FIG. 4.

FIG. 14 is a diagram illustrating the example aiming key 48 as shown in FIG. 4, further including a cut-out 90 that is parallel to the first 56 and second 58 sides. The cut-out 90 is a hole that is within the aiming member 74 and extends through the aiming key 48 from the top surface 80 to the bottom surface 82. The cut-out 90 has a first end 92 and a second end 94. The first end 92 is positioned a distance P from the first end 52 of the aiming key 48 and the second end 94 is positioned a distance R from the end 78 of the aiming member 74. The cut-out 90 may have, for example, an elongated shape and may have a length S. It is contemplated by the present disclosure that the cut-out 90 may alternatively have any shape and any length that facilitate enhancing putting as described herein. The distances P, S and R are variable. Thus, the first end 92 may be any distance P from the first end 52 of the aiming key 48 and the second end 94 may be any distance R from the end 78 of the aiming member 74 that facilitates enhancing the accuracy of a golfer's aim.

The aiming member first side 98 and the aiming member second side 100 extend from the first end 52 to the first interior end 66, and from the first interior end 66 to the end 78. The centerline extends intermediate the first and second aiming member sides and is also the centerline of the cut out 90.

The aiming member 74 may have any width J that facilitates enhancing putting as described herein. It is contemplated by the present disclosure that the aiming member sides 98 and 100 may alternatively not taper to the end 78. Instead, for example, the aiming member sides 98, 100 may extend into the interior opening 60 such that the aiming member has a constant width J in the opening 60.

FIG. 15 is a diagram illustrating the example aiming key 48 as shown in FIG. 14. However, the aiming member 74 does not include a triangular part. Instead, the aiming member 74 includes a part that extends into the interior opening 60 having a constant width J and a rounded end 78. Alternatively, the end 78 may be pointed.

Figure 16:
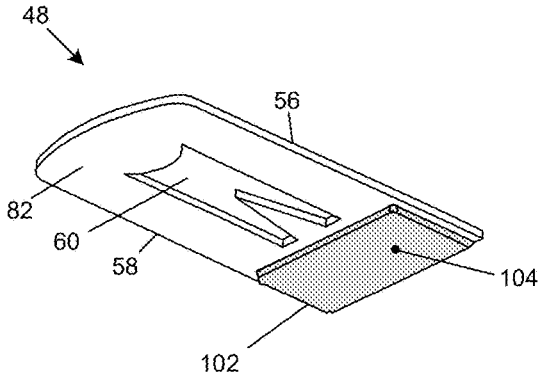
FIG. 16 is a perspective view of the bottom of the aiming key with an adhesive strip applied to the bottom.

FIG. 16 is a perspective view of the bottom 82 of the aiming key 48 having an adhesive strip 102 applied thereto. The adhesive strip 102 can extend from the first end 50 of the aiming key 48 to roughly just before the interior opening 60, between the first side 56 and the second side 58, and away from the bottom 82. The adhesive strip should not cover the interior opening 60.

The adhesive strip 102 includes a bottom surface 104 coated with an adhesive that facilitates attaching the aiming key 48 to the putter head 12 and easily removing the aiming key 48 from the putter head 12. Thus, it should be understood that the aiming key 48 is removably attached to the putter head 12. It is contemplated by the present disclosure that the aiming key 48 may be repeatedly attached to and removed from the putter head 12. Thus, the adhesive should be an adhesive that can be used to repeatedly securely attach the aiming key 48 to, and repeatedly remove the aiming key 48 from the putter head 12. The aiming key 48 may be attached and removed from the putter head 12, for example, tens or hundreds of times. Although an adhesive strip 102 is used to attach the aiming key 48 to the putter head 12, it is contemplated by the present disclosure that the aiming key 48 may alternatively be attached to the putter head 12 in any manner, for example, using Velcro.

For aiming keys 48 that include the cut-out 90, the adhesive strip 102 should not cover the cut-out 90. Thus, the adhesive strip 102 should also include a cut-out so the adhesive strip 102 does not cover any part of the cut out 90.

Figure 17:
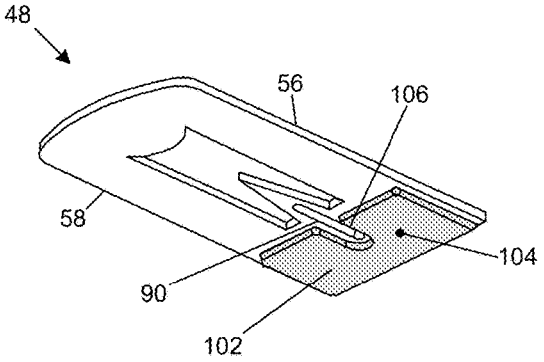
FIG. 17 is a perspective view of the bottom of the aiming key as shown in FIG. 16; however, the adhesive strip includes an example cut out.

FIG. 17 is a perspective view of the bottom 82 of the aiming key 48; however, the adhesive strip 102 includes an example cut out 106 so the adhesive strip 102 does not cover any part of the cut out 90.

Figure 18:
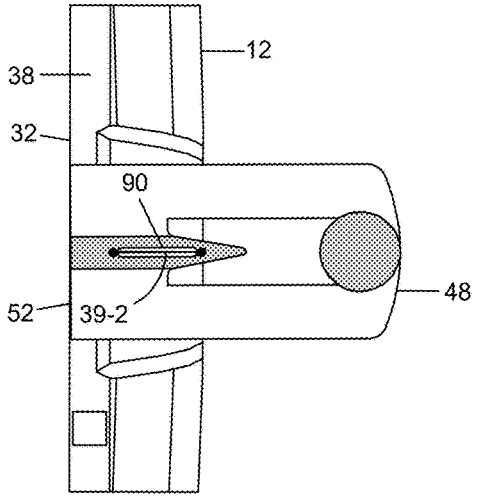
FIG. 18 is a top view of the aiming key attached to the top surface of the putter head.

FIG. 18 is a top view of the aiming key 48 attached to the top surface 38 of the putter head 12. The aiming key 48 may be attached to the putter head 12 by manipulating the aiming key 48 to be proximate the putter head 12, aligning the cut-out 90 with the aiming line 39-2 and the end 52 of the aiming key 48 with the front face 32 of the putter head 12, and positioning the bottom 82 of the aiming key 48 against the top surface 38 of the putter head 12. The aiming key 48 is attached to the putter head 12 by pressing the aiming key 48 and thus the adhesive strip 102 against the top surface 38 of the putter head 12.

Figure 19:
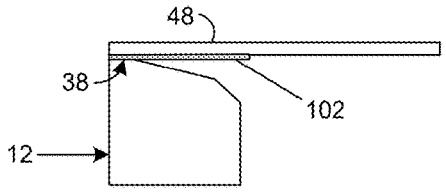
FIG. 19 is a side view of the aiming key attached to the top surface of the putter head.

FIG. 19 is a side view of the aiming key 48 attached to the top surface 38 of the putter head 12.

Figure 20:
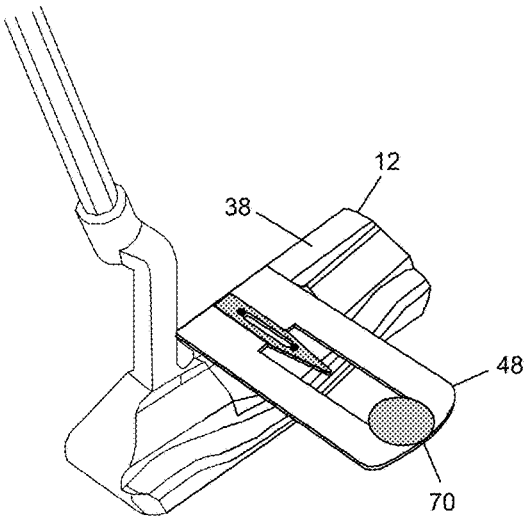
FIG. 20 is an enlarged perspective view of the aiming key attached to the top surface of the putter head.

FIG. 20 is an enlarged perspective view of the aiming key 48 attached to the top surface 38 of the putter head 12 according to an example embodiment of the present disclosure.

Figure 21:
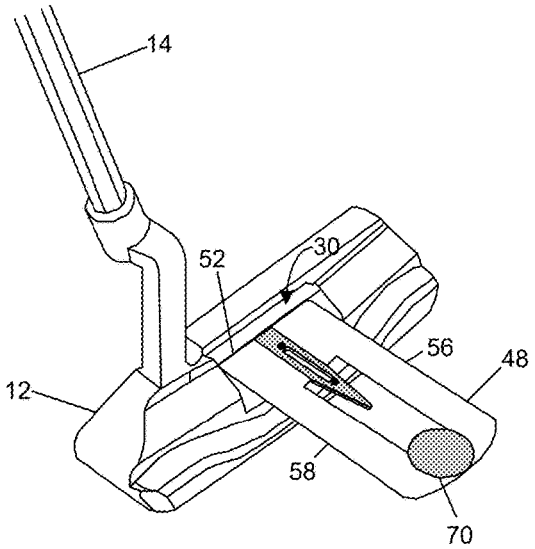
FIG. 21 is an enlarged perspective view of the putter head with the aiming key positioned in a recess of the putter head.

FIG. 21 is an enlarged perspective view of the putter head 12 with the aiming key 48 positioned in the recess 30 according to an alternative example embodiment of the present disclosure. The aiming key 48 may be positioned in the recess 30 such that the first end 52 of the aiming key 48 is positioned flush against the back face 34 of the front portion 22, and the sides 56 and 58 are each positioned against a respective side 42 or 44 of the recess 30. Alternatively, the aiming key 48 may be positioned in the recess 30 such that there can be a gap between the first end 52 and the back face 34, and/or between the sides 56 and 58 and a respective side 42 or 44. The gap may be, for example, one (1) millimeter but alternatively may be any distance that facilitates securely attaching the aiming key 48 to the recess 30 while also facilitating enhancing the accuracy of aiming as described herein. Positioning the aiming key 48 in the recess 30 facilitates enhancing the accuracy of putting a golf ball into a hole in a green using the putter 10.

The bottom surface 82 of the aiming key 48 can be attached to the bottom surface 46 of the recess 30 using, for example, the adhesive strip 102 or Velcro. Alternatively, the aiming key 48 can be attached to the bottom surface 46 in any manner including, but not limited to, welding. Because the aiming key 48 may be attached to the recess 30 using, for example, the adhesive strip 102 or Velcro, the aiming key 48 can be removed from the putter. Thus, it should be understood that the aiming key 48 is removably attached to the putter 10. Instead of attaching the aiming key 48 to the head 12 after manufacturing, it is contemplated by the present disclosure that the aiming key 48 may be included as part of the head 12 during manufacture such that the aiming key 48 is an integral part of the putter head 12.

Putting involves gently swinging the head of a putter across a golfer's body, from one side to another, to gently hit a golf ball in the direction of the hole located in the green. Typically, a golfer aims at the hole using the line etched into his or her putter. After mentally establishing a desired alinement or path between the face of the putter, the ball and the hole, the golfer gently executes his or her putting stroke to strike the ball. However, golfers generally do not face the hole and generally do not concentrate on gently hitting the golf ball into the hole while putting. Instead, golfers face the golf ball and concentrate on making contact with the golf ball while putting. As a result, more often than not the golf ball does not follow the desired path so does not go into the hole.

The ball may not follow the desired path because the golfer may move the putter off the desired alinement or path while executing his or her putting stroke. More specifically, while executing his or her putting stroke the golfer may move the head 12 in a curve or in any other manner that diverges from the desired alinement. Thus, when the head 12 strikes the golf ball it does not move along the desired alinement into the hole.

To address these problems a method for enhancing the accuracy of aiming while putting a golf ball can be implemented using a putter that includes an aiming key. The head 12 of the putter 10 can include the aiming key. The aiming key includes a body having a first end and a second end. The second end includes a target and the first end includes an aiming member. Moreover, the body includes top and bottom surfaces separated by a distance, and an interior opening extending part of the distance from the top surface to the bottom surface. The aiming member extends into the opening and towards a center of the target. The method for enhancing the accuracy of aiming while putting a golf ball can include focusing on the end of the aiming member and aligning the end with a hole in the ground, executing a putting stroke while concentrating on moving the end of the aiming member towards the center of the target, and striking the golf ball to translate the golf ball along the alinement towards the hole.

Figure 22:
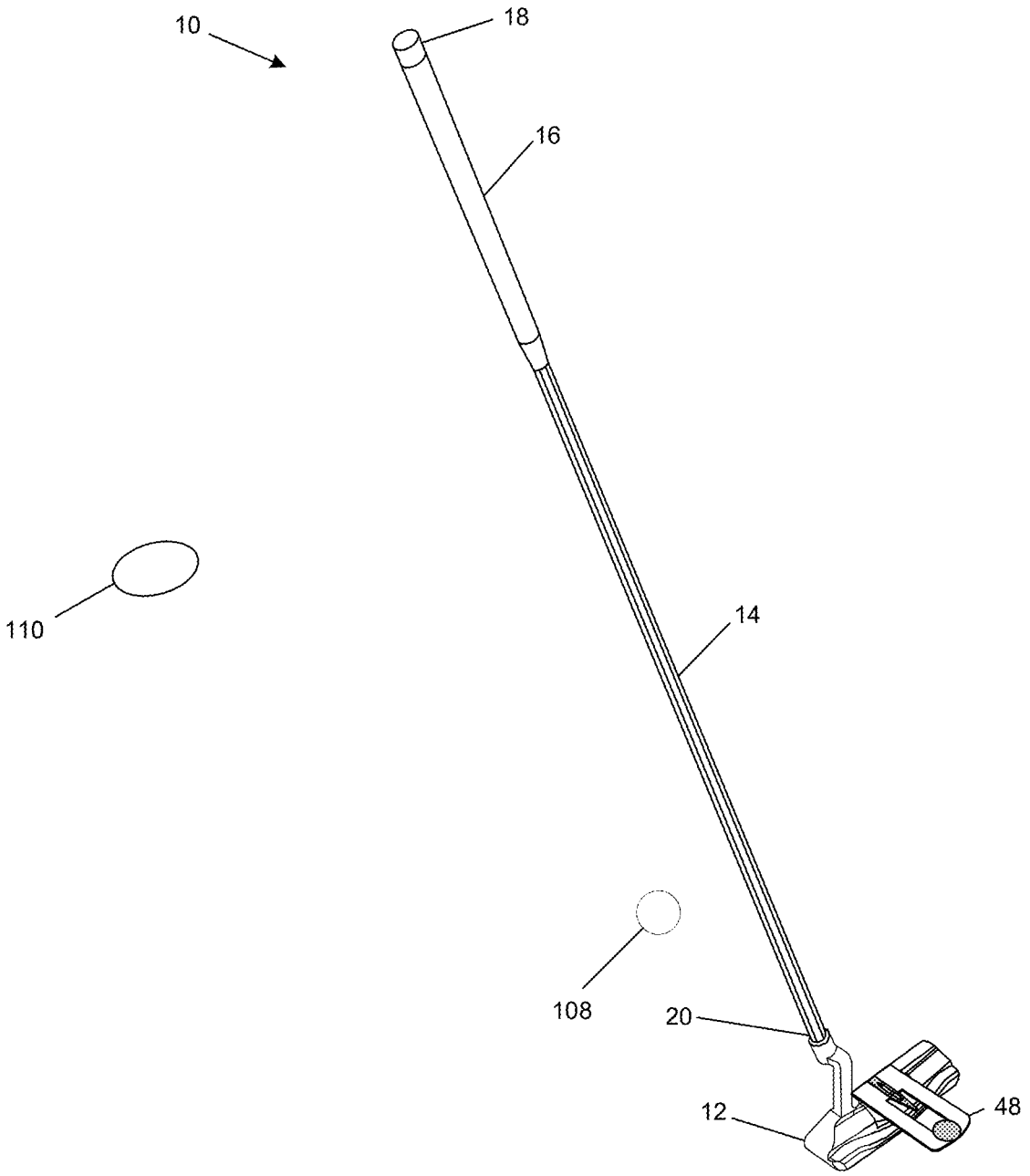
FIG. 22 is a diagram illustrating the putter in which the aiming key is attached to the putter head while the putter is used to execute a putt.

FIG. 22 is a diagram illustrating the putter 10 in which the aiming key 48 is attached to the putter head 12 while the putter 10 is used to execute a putt by hitting a golf ball 108 into a hole 110 in a green. More specifically, a golfer maneuvers the putter 10 about the ball 108, focusses on the end 78 of the aiming member 74 and aligns the end 78 with the hole 110 to establish a desired alinement or path. Next, the golfer gently executes his or her putting stroke while concentrating on moving the end 78 towards the center 72 of the target 70. Doing so facilitates causing the golfer to swing the putter 10 along the desired alinement. As a result, a golfer's aim and putting accuracy are facilitated to be enhanced.

Frequently while executing his or her putting stroke using a putter 10 including the aiming key 48, a golfer may move the head 12 in a manner that diverges from the desired alinement. The aiming key 48 as shown in FIGS. 5 and 6 that includes a rotatable target 70 may be used to facilitate reducing divergence from the desired alinement. For example, the target 70 may be oriented such that twelve o'clock lies on the line between the aiming member 74 and the center 72 of the target 70. When there is divergence from the desired alinement during the putting stroke, the target 70 can be rotated to account for the divergence. For example, the target 70 can be rotated such that eleven o'clock lies on the line between the aiming member 74 and the center 72 of the target 70. Thus, while concentrating on moving the end 78 of the aiming member 74 towards the center 72 of the target 70 during putting, the golfer will automatically correct his or her swing such that the putter head 12 is facilitated to be swung along the desired alinement.

It is contemplated by the present disclosure that rotation of the target 70 may be proportional to the divergence from a desired alinement. Thus, a large divergence warrants a large rotation while a small divergence warrants a small rotation. For example, a large divergence may warrant rotating the target three (3) increments so that three o'clock lies on the line between the aiming member 74 and the center 72 of the target 70. A small divergence may warrant rotating the target 70 one increment so eleven o'clock lies on the line between the aiming member 74 and the center 72 of the target 70.

Although the example putter head 12 described herein is a blade type putter head, it is contemplated by the present disclosure that the putter head 12 may be any type of putter head, including, but not limited to, a mallet type putter head.

Figure 23:
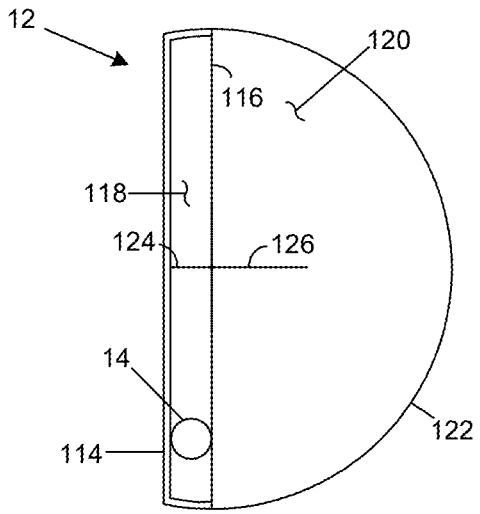
FIG. 23 is an enlarged top view of an alternative example golf putter head that can be included in the golf putter as shown in FIG. 1.

FIG. 23 is an enlarged top view of an alternative example golf putter head 12 that can be included in the golf putter 10 as shown in FIG. 1. The alternative golf putter head 12 is a mallet type putter head. Thus, the golf putter 10 can include the mallet type putter head 12 instead of the blade type putter head as shown in FIGS. 1, 14 and 15.

The mallet type putter head 12 includes a front face 114, a back face 116, a top surface 118, and a back portion 120 extending away from the back face 116 to define a rear edge 122. The back portion 120 does not include a recess and the rear edge 122 is curved. The top surface 118 includes an aiming line 124 and the back portion 120 also includes an aiming line 126. The aiming lines 124, 126 may be etched in the putter head 12.

The rear edge 122 may be any type of curve including, but not limited to, a semicircle. Alternatively, the rear edge 122 may have any other geometric shape such as, but not limited to, rectangular, square, and triangle. The aiming key 48 may be attached to the back portion 120 using the adhesive strip 102 or Velcro, or may be welded to the back portion 120 to facilitate enhancing the accuracy of aiming while golfing as described herein. The aiming key 48 may alternatively be manufactured with the mallet type putter head 12 to be integral with the mallet type putter head 12.

It is contemplated by the present disclosure that the second end 54 of the aiming key 48 may have the same shape as the rear edge 122 such that the second end 54 is coincident with the rear edge 122. Thus, the second end 54 of the aiming key 48 may be any shape including, but not limited to, semicircular, oval, rectangular, and triangular that matches the shape of the rear edge 122.

Figure 24:
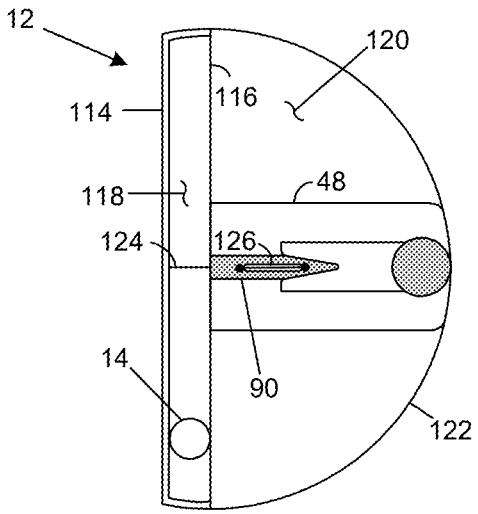
FIG. 24 is a top view of the aiming key attached to a back portion of the putter head as shown in FIG. 23.

FIG. 24 is a top view of the aiming key 48 attached to the back portion 120 with the cut-out 90 centered about the aiming line 126.

Figure 25:
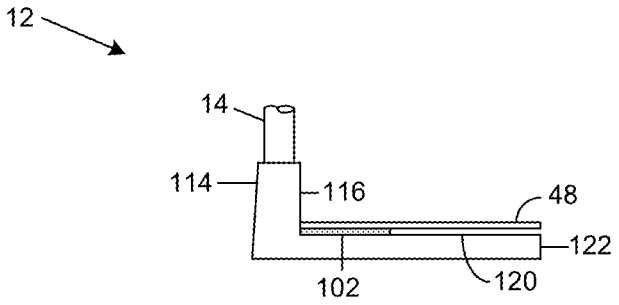
FIG. 25 is a side view of the mallet type putter head as shown in FIG. 24 with the aiming key attached thereto.

FIG. 25 is a side view of the mallet type putter head 12 as shown in FIG. 24. More specifically, the aiming key 48 is attached to the back portion 120 of the mallet type putter head 12 via, for example, the adhesive strip 102.

Figure 26:
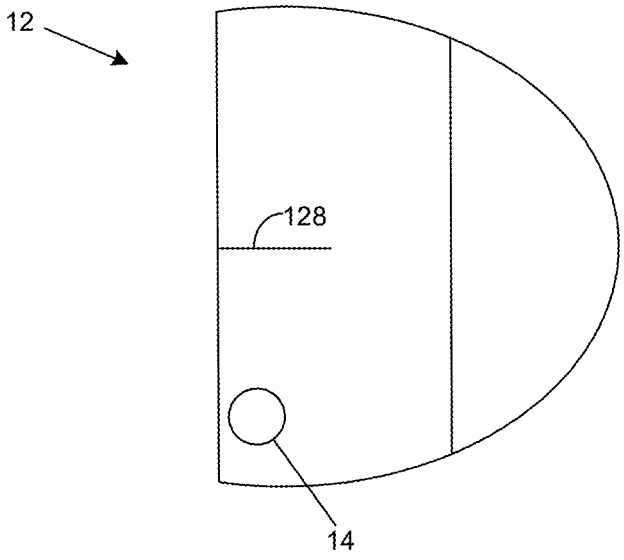
FIG. 26 is an enlarged top view of another alternative example golf putter head that can be included in the golf putter as shown in FIG. 1.

FIG. 26 is an enlarged top view of another alternative example golf putter head 12 that can be included in the golf putter 10 as shown in FIG. 1. The putter head 12 includes an aiming line 128 that may be etched therein. The alternative golf putter head 12 is another type of mallet type putter head.

Figure 27:
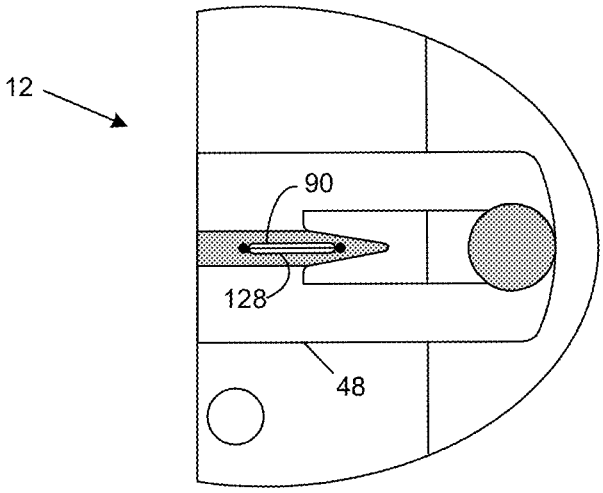
FIG. 27 is a top view of the aiming key attached to the mallet type putter head as shown in FIG. 26.

FIG. 27 is a top view of the aiming key 48 attached to the mallet type putter head 12.

Figure 28:
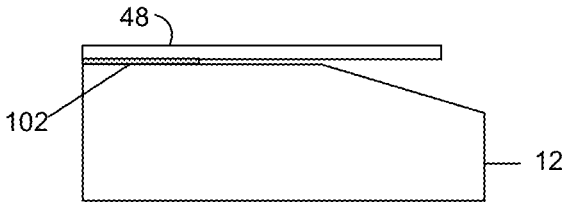
FIG. 28 is a side view of the aiming key attached to the top of the mallet type putter head.

FIG. 28 is a side view of the aiming key 48 attached to the top of the putter head 12, similar to that shown in FIG. 24. The aiming key 48 is attached to the putter head 12 as described herein with regard to FIG. 18.

Although the example putter head 12 is described herein as a blade type putter head and a mallet type putter head, it is contemplated by the present disclosure that the putter head 12 may be any type of putter head including variations of the blade and mallet type putter heads described herein to which the aiming key 48 can be attached to facilitate enhancing the accuracy of a golfer's aim during putting.

The aiming key 48, putter 10 and method of putting as described herein facilitate quickly enhancing a golfer's aim and thus the accuracy of putting for any golfer including professionals and amateurs. As a result, the number of putts required to navigate the golf ball into the hole is facilitated to be reduced and golfers have more time to work on other areas of their golf games that they may enjoy more than putting. Accordingly, golfer performance and competitiveness are both facilitated to be enhanced.

The above description provides examples, and is not limiting of the scope, applicability, or configuration set forth in the claims. Changes may be made in the function and arrangement of elements discussed without departing from the spirit and scope of the disclosure. Various embodiments may omit, substitute, or add various features as appropriate. For instance, features described with respect to certain embodiments may be combined in other embodiments.

What is claimed is:

1. An aiming key for enhancing the accuracy of aiming while putting a golf ball comprising a body, the body comprising:

a pair of parallel sides, each side having a first terminus and a second terminus;

a first end extending between the first terminus of each side, the first end being removably attachable to a putter;

an arcuate second end extending between the second terminus of each side;

a circular target proximate the second arcuate end;

an interior opening including a first interior end and a second interior end, the interior opening extending through the body and being between the parallel sides; and an aiming member aimed at a center of the target, the aiming member including a first aiming member side, a second aiming member side, an aiming member end and an elongated cut-out intermediate the first and second aiming member sides, wherein the cut-out and the aiming member sides are parallel to the parallel sides and the cut-out extends through the body from between the first end and the first interior end and beyond the first interior end into the interior opening.

2. The aiming key according to claim 1, wherein:

the aiming member extends a first length from the first end to the first interior end and a second length from the first interior end to the aiming member end; and the second length is within the interior opening.

3. The aiming key according to claim 1, wherein the aiming member end is separated from the target by a distance.

4. The aiming key according to claim 1, wherein:

the aiming member comprises a triangular portion that tapers from the first interior end to the aiming member end; and the aiming member end is within the interior opening and is separated from the target by a distance.

5. The aiming key according to claim 1, wherein the target protrudes into the interior opening.

6. The aiming key according to claim 1, wherein the target includes a clockface that includes numerals and all of the numerals are visible.

7. The aiming key according to claim 1, wherein a centerline of the aiming member extends intermediate the first and second aiming member sides, intermediate the first and second sides, and through a center of the target.

8. An aiming key for enhancing the accuracy of aiming while putting a golf ball comprising a body, the body comprising:

a first end and an arcuate second end, the first end being removably attachable to a putter;

a circular target proximate the arcuate second end;

a first side and a second side, the first and second sides being parallel, the first side having a first side end and a second side end, the second side having a first side end and a second side end, wherein the first end extends from the first side first end to the second side first end and the arcuate second end extends from the first side second end to the second side second end;

an interior opening including a first interior end and a second interior end, the interior opening extending through the body and being between the first and second sides; and an aiming member aimed at a center of the target, the aiming member including a first aiming member side, a second aiming member side, an aiming member end and an elongated cut-out intermediate the first and second aiming member sides, the aiming member end is separated from the target by a distance, wherein the cut-out and the aiming member sides are parallel to the first and second sides, the cut-out extends through the body from between the first end and the first interior end and beyond the first interior end into the interior opening.

9. The aiming key according to claim 8, wherein the target is a clockface having numerals and all the numerals are visible.

10. The aiming key according to claim 8, wherein:

the aiming member extends a first length from the first end to the first interior end and a second length from the first interior end to the aiming member end; and the second length is within the interior opening.

11. The aiming key according to claim 8, wherein a centerline of the aiming member extends intermediate the first and second aiming member sides, intermediate the first and second sides, and through a center of the target.

12. The aiming key according to claim 8, wherein:

the aiming member comprises a triangular part that tapers from the first interior end to the aiming member end; and the aiming member end is within the interior opening.

13. The aiming key according to claim 8, wherein the target protrudes into the interior opening.

14. The aiming key according to claim 8, wherein the target and the arcuate second end are eccentric.

15. The aiming key according to claim 8, wherein the distance is between the aiming key end and the perimeter of the target.

* * * * *